US006614910B1

(12) United States Patent
Clemow et al.

(10) Patent No.: US 6,614,910 B1
(45) Date of Patent: Sep. 2, 2003

(54) STEREO SOUND EXPANDER

(75) Inventors: Richard David Clemow, Bucks (GB); Alastair Sibbald, Berks (GB)

(73) Assignee: Central Research Laboratories Limited, Middlesex (GB)

( * ) Notice: Subject to any disclaimer, the term of this patent is extended or adjusted under 35 U.S.C. 154(b) by 0 days.

(21) Appl. No.: 09/297,460

(22) PCT Filed: Nov. 3, 1997

(86) PCT No.: PCT/GB97/03020

§ 371 (c)(1),
(2), (4) Date: Jul. 16, 1999

(87) PCT Pub. No.: WO98/20707

PCT Pub. Date: May 14, 1998

(30) Foreign Application Priority Data

Nov. 1, 1996 (GB) ..... 9622773

(51) Int. Cl.[7] ..... H04R 25/00

(52) U.S. Cl. ..... 381/1; 381/17; 381/309; 381/103

(58) Field of Search ..... 381/1, 17, 18, 381/103, 309, 310

(56) References Cited

U.S. PATENT DOCUMENTS

| | | | | |
|---|---|---|---|---|
| 4,192,969 A | * | 3/1980 | Iwahara | 381/1 |
| 4,219,696 A | | 8/1980 | Kogure et al. | |
| 4,359,605 A | * | 11/1982 | Haramoto et al. | 381/17 |
| 5,173,944 A | | 12/1992 | Begault | |
| 5,371,799 A | | 12/1994 | Lowe et al. | |
| 5,440,638 A | * | 8/1995 | Lowe et al. | 381/17 |

FOREIGN PATENT DOCUMENTS

| | | |
|---|---|---|
| DE | 34 34 574 | 4/1985 |
| WO | WO 89/03632 | 4/1989 |
| WO | WO 95/15069 | 6/1995 |

* cited by examiner

*Primary Examiner*—Curtis Kuntz
*Assistant Examiner*—Tuan Duc Nguyen
(74) *Attorney, Agent, or Firm*—Crowell & Moring LLP

(57) ABSTRACT

A stereo sound expander reproduces a realistic sound image in three dimensions by coupling modified and unmodified stereo signals. By not modifying a Head Related Transfer Function (HRTF) for one signal and equalizing the HRTF for the other signal, a flattened frequency response is produced with no tonal changes, but with a high degree of spatial accuracy. Resultant output signals may be used to generate binaural signals or can be fed into crosstalk cancellers.

10 Claims, 6 Drawing Sheets

Sensaura/Stereo at Ears, pan=1.00, XTALK-CANCEL ON

Sensaura/Stereo at Ears, pan=0.50, XTALK-CANCEL ON

STEREO SOUND EXPANDER

FIELD OF THE INVENTION

This invention relates to converting a stereo audio signal to a signal which when reproduced appears to a listener to have a more realistic sound image in three dimensions than the original stereo signal. Such conversion is commonly referred to as stereo expansion, and will hereinafter be referred to as such.

BACKGROUND ART

The basic patent to stereo, GB-A-394325 (EMI) describes and claims a system for producing stereo signals wherein the relative loudness of the loudspeakers is made dependent upon the direction from which the sounds arrive at the left and right input microphones. The system incorporates sum and difference circuits, the outputs of which are coupled to respective filters. Such sum and difference circuits have subsequently been incorporated into many different types of stereo systems, especially stereo expansion systems.

There are numerous stereo widening methods which with varying degrees of success attempt to widen the stereo sound image. A common element of many of these methods is the use of such sum and difference circuits, whereby the stereo input left and right signals are added and processed in one way, and the input signals are also subtracted and processed in a different way, the two such paths being recombined to produce the converted output signals. These methods are all synthetic, in the sense that they have no basis in accurate modelling of the processing theoretically required to widen the sound image. For example U.S. Pat. No. 4,748,669 to Klayman describes a stereo enhancement system which generates sum and difference signals and circuitry, including a spectrum analyser, for selectively modifying the signals.

A better method is to use so-called Head Response Transfer Functions (HRTFs), which are filters which represent the response of an artificial or human head and ears to a sound arriving from a particular direction. By the use of HRTFs, a converter can be produced which accurately models the theoretical equations which describe the widening process. U.S. Pat. No. 5,371,799 to Lowe describes a system for e.g. a video game played on a personal computer, wherein an input audio signal is applied both to left and right HRTFs, the HRTFs being modified according to the required apparent location of the audio signal source. These methods are sometimes referred to as creating virtual speakers or sources to position two speakers apparently outside the actual physical speaker positions. The problem with these methods is that there is a tonal quality change (sometimes referred to as an equalisation change) associated with the use of HRTFs to create virtual sources or speakers. This effect is undesirable and is not acceptable in many applications.

It is possible to correct for this tonal change by equalising both the input (or output) left and right signals to compensate for the tonal change produced by the HRTFs, but if this is done, the positional accuracy of the virtual sound source, speaker or loudspeaker is impaired, particularly if the virtual speakers are widely spaced.

SUMMARY OF THE INVENTION

It is an object of the present invention to provide a system of stereo expansion without causing a tonal change.

The invention is based on the fact that a typical pair of HRTFs (near ear and far ear) have a useful property; that is, that the far ear function is diminished in amplitude much more than the near ear function, especially at higher frequencies. This means that when HRTF pairs are used to create a virtual source most of the energy from the virtual source is associated with the near ear. Thus the listener perceives a tonal quality dominated by the near ear HRTF. Use can be made of this property. Both the near and far ear HRTFs can be equalised with the inverse of the near ear HRTF, thus rendering the near ear HRTF flat. Thus the ear perceives a tonal quality dominated by the near ear HRTF, which is flat. The effect is that the overall frequency response is substantially flat, and hence the tonal quality is correct. However, if this is actually implemented, it is found that the equalisation of the far ear by the same equalisation function (inverse of near ear) impairs the localisation accuracy, and the end result is not satisfactory.

However, it has been discovered that if the far ear HRTF is NOT modified, and the near ear HRTF is equalised with its own inverse as described above, i.e. it is rendered neutral and has a flattened frequency response, the stereo expander has the benefits of an apparently flat response, i.e. no tonal change, but also has the full localisation accuracy. This is the basis of the present invention. A flat response filter is of course a straight-through connection; no filtering is actually required.

The present invention provides stereo expansion apparatus comprising first and second inputs for receiving respective left and right stereo signals, the first input being coupled through a first channel which does not significantly alter the frequency characteristics of the stereo signal to a first summing means and the first input being coupled, via a filter representing a far ear HRTF for a listener, to a second summing means, and the second input being coupled through a second channel which does not significantly alter the frequency characteristics of the stereo signal to said second summing means, and, via a filter representing a far ear HRTF for a listener, to the first summing means, the outputs of the summing means providing stereo expanded signals.

The apparatus in accordance with the invention can be used either to generate binaural signals suitable for headphone listening, or can be fed into a crosstalk canceller, such as that described in our copending application WO-A-9515069 in order to generate signals suitable for loudspeaker reproduction.

In accordance with a preferred feature of the invention, an equaliser is provided to compensate for any average deviation. Preferably an equaliser is provided which has a characteristic which equalises both left and right channels either before or after stereo expansion.

It will be understood for the purposes of this specification, that HRTF or head related transfer function is intended to mean a function representing the frequency response of a path between a source of sound and the ear of the listener, either the ear nearer the sound (near HRTF) or the ear further from the sound (far HRTF). HRTFs may be obtained by measurements on a real human head equipped with suitable microphones; alternatively they may be obtained using an artificial head means, which may be as is common a precise model of a human head and torso with microphones in the ear structures; alternatively it may be something far less precise, for example a block or sheet of wood positioned between a pair of spaced apart microphones; it might even be an electrical synthesis circuit or system which creates such functions. It will be understood HRTFs are widely published—see for example—Measuring a dummy head in search of pinna cues—H L Han, J. Audio Eng. Soc., January/February 1994, 42, (1/2),pp.15–36

BRIEF DESCRIPTION OF THE DRAWINGS

Preferred embodiments of the invention will now be described with reference to the accompanying drawings, wherein.

DESCRIPTION OF THE PREFERRED EMBODIMENTS

Figure 1:
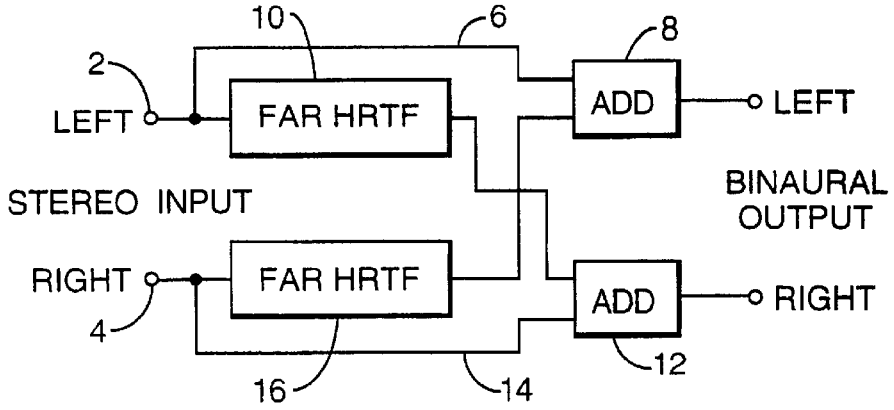
FIG. 1 is a block diagram of a first embodiment of the invention, suitable for use with headphones.

Referring now to FIG. 1 there is shown stereo expansion apparatus comprising first and second inputs 2,4 for LEFT and RIGHT stereo input signals. The left input is connected through a first channel 6 to a first summing circuit 8. First channel 6 is shown as a direct connection and has a flat frequency response, i.e., it produces no significant change to the frequency characteristics of the left stereo signal. It may however include delay circuits and attenuator circuits. Input 2 is also coupled via a filter 10 to a second summing circuit 12. Filter 10 represents the far ear HRTF (Head Related Transfer Function) associated with the position of each "virtual source", and the HRTF incorporates the time delays and diffraction effects caused by the presence of the listener's head.

Second input 4 is connected through a second channel 14, with similar characteristics to that of channel 6, to a second input of second summing circuit 12. Input 4 is also connected through a filter 16, which also represents a far ear HRTF function associated with the position of each "virtual source", to a second input of first summing circuit 8. The outputs of summing circuits 8, 12 provide left and right binaural outputs to stereo headphones.

The implementation of the far ear HRTF can be analogue (i.e. a filter circuit) or digital (e.g. a FIR filter). Note that the far ear HRTF includes a time-delay which represents an interaural time-delay for the virtual source angle. The ADD function can be digital (i.e. an accumulator) or analogue (e.g. an operational amplifier circuit). It will be understood in a practical application, e.g. a video game on a personal computer, there may be a stored library of HRTFs for various positions of virtual angles, and these will be switched into the circuit of FIG. 1 depending on the sound position it is desired represent.

Figure 2:
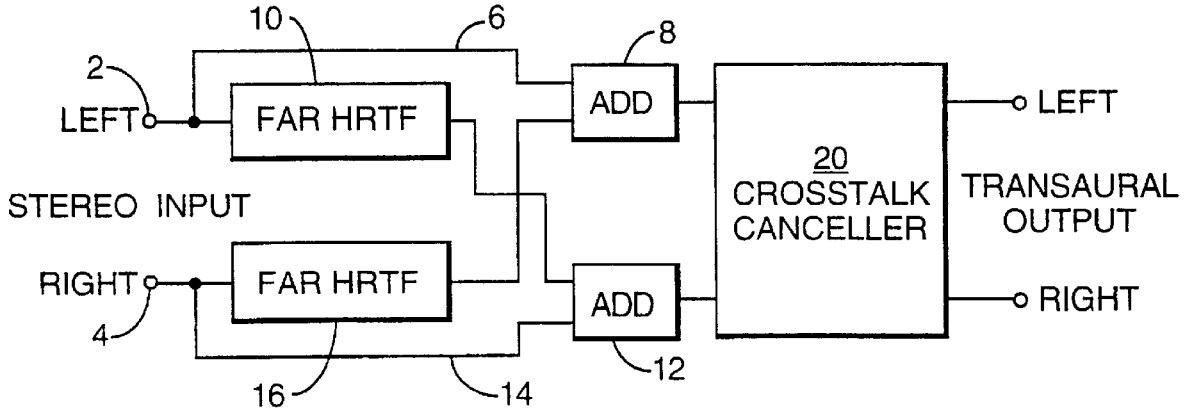
FIG. 2 is a block diagram of a second embodiment of the invention, suitable for use with loudspeakers.

Referring now to FIG. 2, this shows a second embodiment of the invention suitable for use with loudspeakers. Similar parts to those of FIG. 1 are represented with the same reference numerals. The outputs of summing circuits 8, 12 are coupled to a crosstalk cancellation circuit 20. This provides in known manner (see for example published International Patent Application No. WO A-95150679 compensation for signals transmitted from loudspeakers so that the binaural effect is preserved at the listener's head, and the outputs from the left and right loudspeakers do not create crosstalk which destroys the binaural effect.

One common method of creating a form of stereo recording is to "panpot" one or more mono sources, which means that the stereo effects are derived by panning each mono source between the left and right channels, thus creating relative amplitude differences. This method may be employed for example in a video game for a PC, where a library of mono sounds are stored, and it is desired to generate a stereo composite. It is found that such a stereo signal, when fed into the embodiments of FIGS. 1 and 2, is tonally correct when panning hard to either side, but that there is a tonal inaccuracy which gradually increases as the source is panned into the centre (mono) position. This effect may be understood as follows.

When mono signals are replayed through a stereo pair of loudspeakers (to a listener in the usual listening position), identical signals are broadcast from both loudspeakers at the same time. Consequently, the right ear receives the right-speaker signal, followed shortly afterwards by a similar signal from the left-speaker (and vice versa). At low frequencies, the diffractive effects caused by the head are small, and so each ear receives a primary signal (right-ear from right-speaker, and left-ear from left-speaker), followed by a secondary signal (right-ear from left-speaker and left-ear from right-speaker), the latter caused by transaural crosstalk. The secondary signals are delayed with respect to the primary signals by about 0.227 ms, because of the extra distance they must travel around the head. Consequently, when the primary and secondary sound-waves add together, at certain periodically recurring frequencies there will be destructive and constructive interference, causing comb-filtering, with the first minimum at around 2.2 kHz. As a result, when a mono signal is played through a pair of stereo loudspeakers to a listener in the usual listening position (forming an equilateral triangle with the loudspeakers), the signal is comb-filtered by acoustic interference. However, when it is panned to the extreme left or right, then the sound is emitted by only one of the two loudspeakers, and so there is no wave addition, and so there is no comb-filtering effect.

It has been found that this effect can be compensated for without loss of positional accuracy by equalising both input channels or both output channels in an appropriate way. In this context, equalisation is intended to mean providing a transfer function which compensates for the anticipated comb-filtering effect so as to produce a signal for the listener which is not tonally distorted. This applies to both binaural and transaural arrangements. Such equalisation can be designed in any of the following three ways:

1. No equalisation; in which case the hard panned positions are tonally correct, and the centre position is least accurate
2. Making the centre position tonally flat; in which case the hard panned left and right positions become the least accurate
3. Making an intermediate position flat; in which case both centre and the extremes are in error, but the average error is smaller than that in cases 1 or 2.

Figure 4:
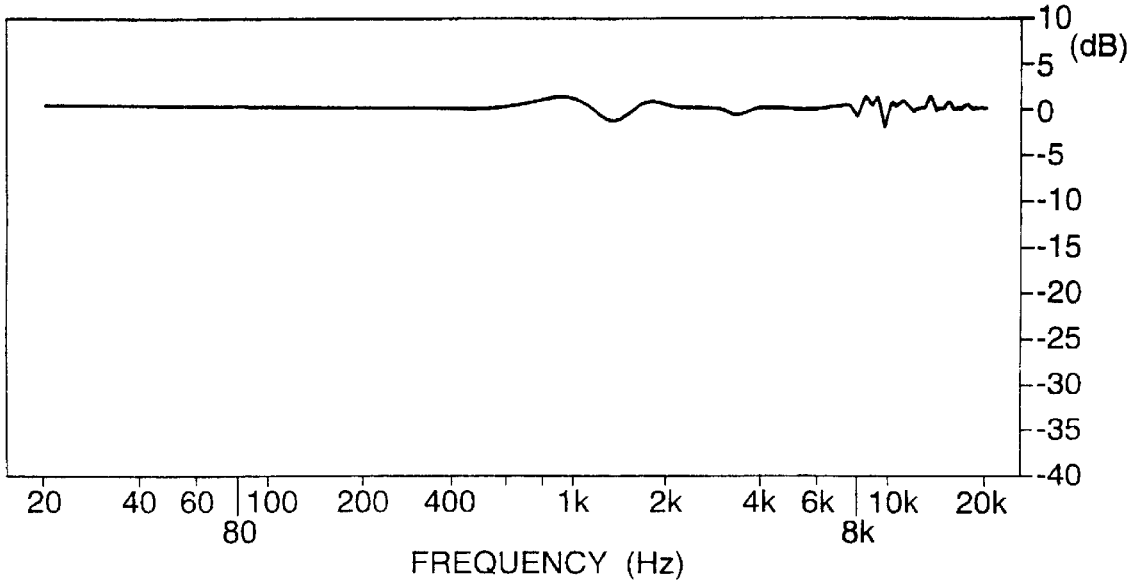
FIGS. 4 to 6 are graphs of equalisation characteristics for the embodiment of FIG. 3.
Figure 5:
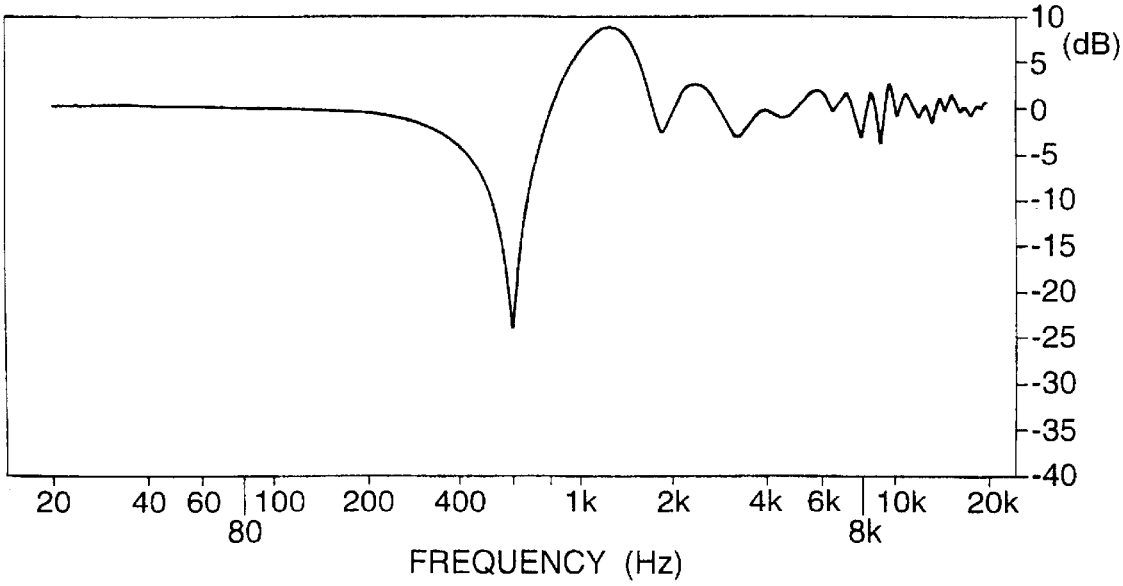
Figure 6:
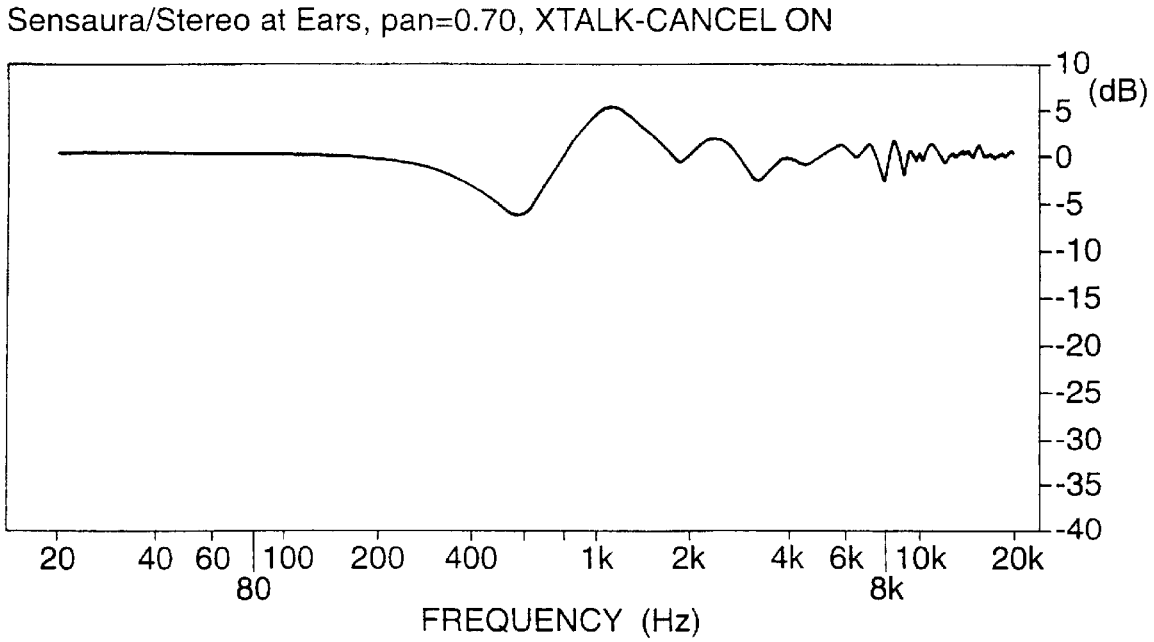

The responses shown in FIGS. 4 to 6 are based on an expander using ±80 degree virtual speakers. This means that a sound source hard panned to the right (which would normally be at 30 degrees to the right, using conventional speaker angles), would appear at 80 degrees to the right using the expander, and the physical speakers are still at ±30 degrees. FIGS. 4, 5 and 6 show what happens when a mono signal is expanded to stereo by panpotting. Each graph shows a different panpot ratio. FIG. 4 shows a graph with hard panning fully to one side. FIG. 5 shows a graph illustrating panning to the centre (mono). FIG. 6 shows a graph illustrating an intermediate position, roughly half way between these extremes. The graphs in FIGS. 4, 5 and 6 represent the ratio of spectra produced by an expander system of the present invention to spectra produced by a stereo signal produced by panpotting. It is this ratio which is important, as it represents the impression of tonal deviations from a conventional stereo signal, to which a listener is accustomed. Thus by introducing equalisation to compensate for the function shown in FIGS. 4 to 6, one can revert to "stereo listening quality" but with three dimensional impressions.

FIG. 4 is virtually flat, showing that when the source is hard panned all the way to one side, the expander sounds exactly tonally the same as stereo, which is acceptable for most purposes.

FIG. 5 shows the mono case (pan=0.50), and shows that there is a combing effect which introduces a deviation from stereo.

FIGS. 4 and 5 are the two extremes. The average deviation is to occurs in some position roughly midway between these two extremes, as shown in FIG. 6 (pan=0.70).

In accordance with a preferred feature of the invention, an equaliser is provided to compensate for the average deviation. An equaliser is provided which has a characteristic the inverse of FIG. 6 to equalise both left and right channels (either before or after stereo expansion in accordance with the invention), then the expander will be correct at the FIG. 6 panpot position, and will be in error at either of the two extremes.

Figure 3:
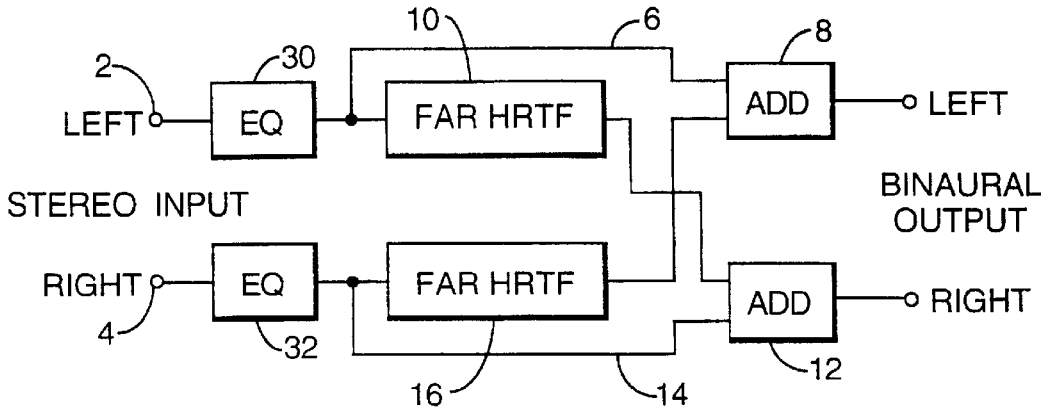
FIG. 3 is a block diagram of a third embodiment, similar to FIG. 1, but employing equalisation stages.

Referring now to FIG. 3, this shows a third embodiment of the invention embodying the above considerations. Similar parts to those of FIG. 1 are denoted by similar reference numerals. The circuit includes equaliser circuits 30, 32 each having comb-filtering compensation transfer functions (the inverse of FIG. 6) coupled between inputs 2 and 4 and channels 6 and 14. The outputs of summing circuits 8, 12 are applied to stereo headphones. In a modification, circuits 30, 32 are placed at the outputs of summing circuits 8, 12.

Figure 7:
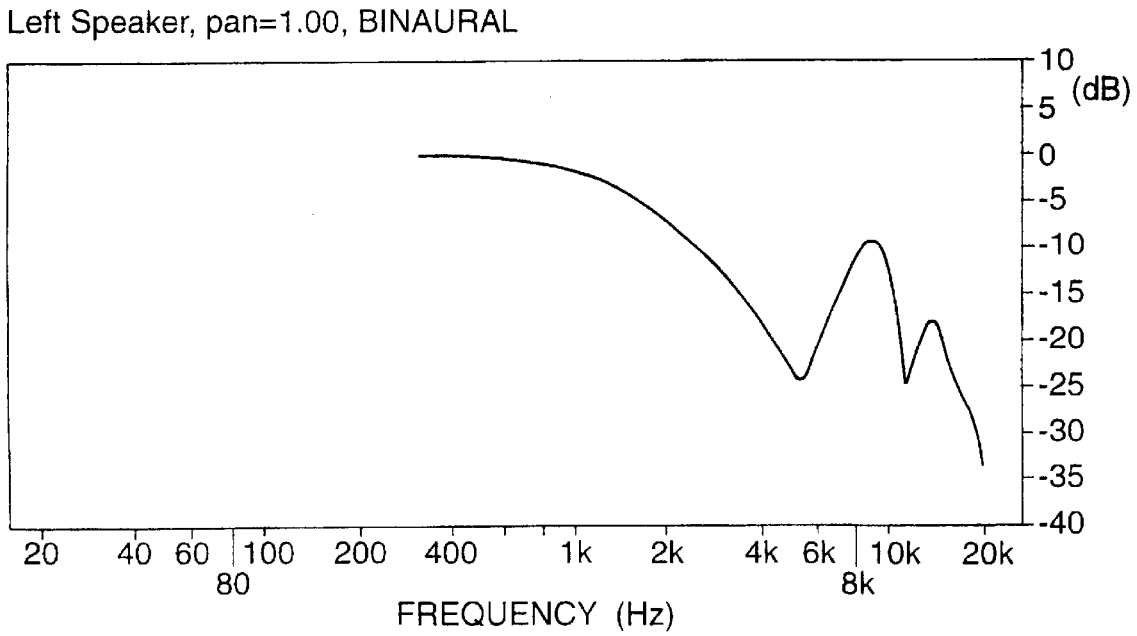
FIGS. 7 to 9 are representations of near and far HRTFs
Figure 8:
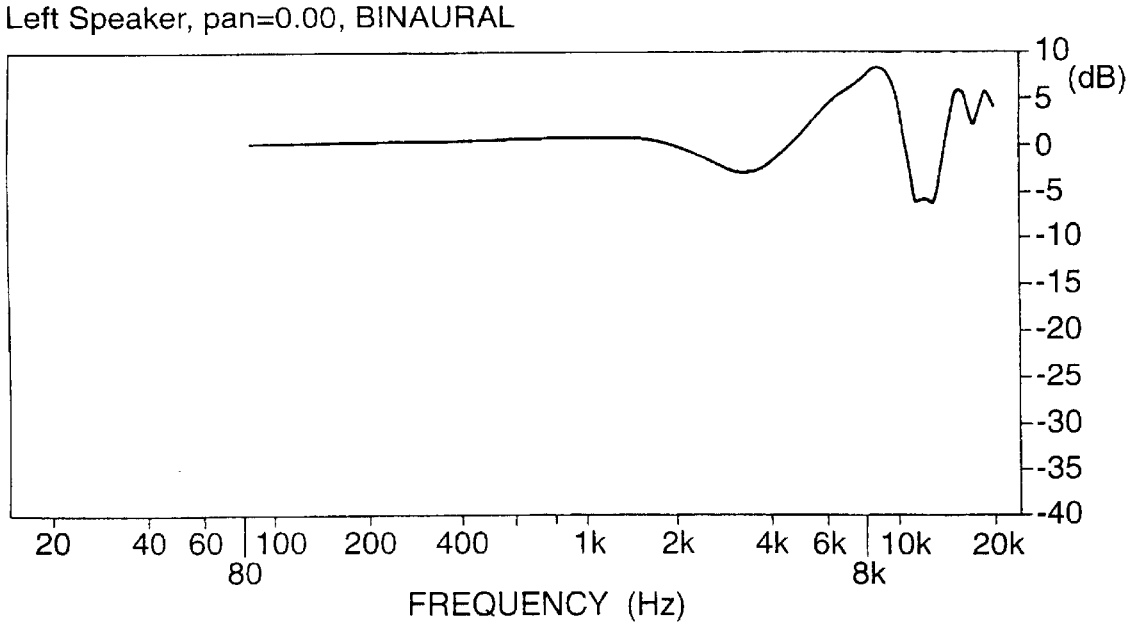

FIGS. 7 and 8 show the FAR ear and NEAR ear HRTFs respectively for 80 degrees. It may be observed that the FAR ear function falls off markedly with frequency, from about 1 kHz. In the present invention, the NEAR ear HRTF is of course not used, as it is replaced by a flat response.

Figure 9:
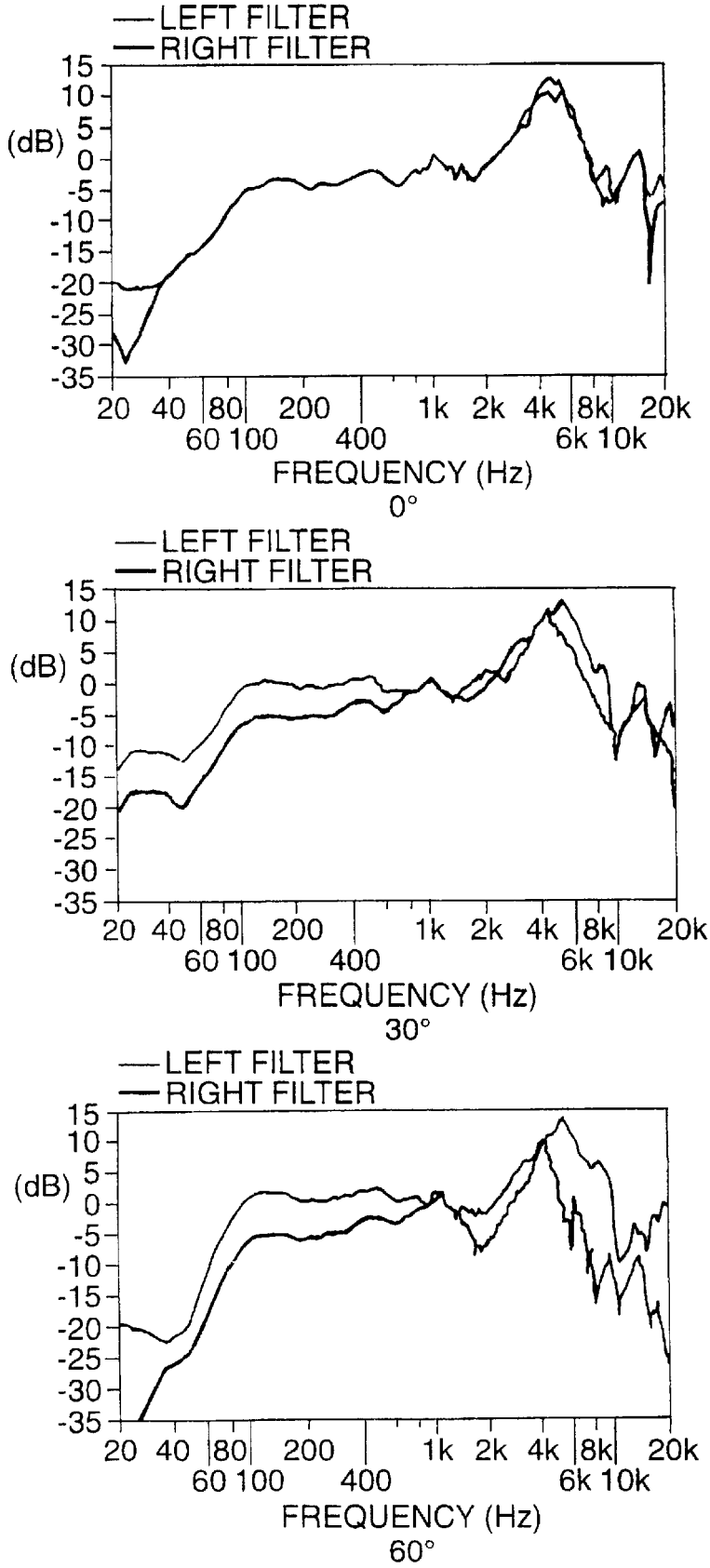
Figure 9:
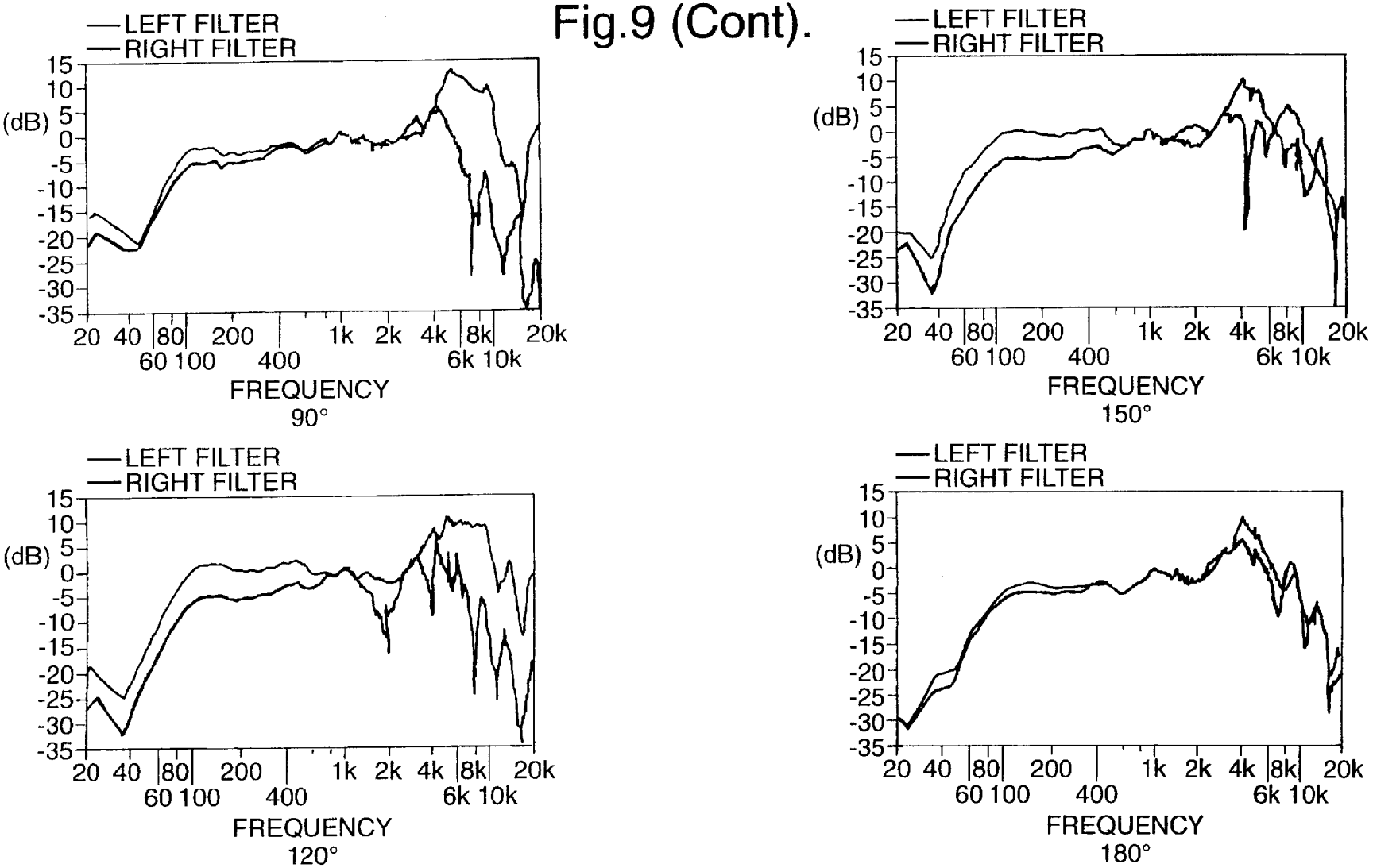

It will be appreciated that in the present invention, in the application to sound effects for a video game, the HRTFs employed in the circuits shown will be selected from a store containing a library of HRTFs, representing different apparent angles of incident sound at the ear of a listener, depending on what angle of incident sound has to be represented. In FIG. 9 is shown representations of HRTFs for various listening angles.

What is claimed is:

1. Stereo expansion apparatus comprising first and second inputs for receiving respective left and right stereo signals, the first input being coupled through a first channel which does not significantly alter the frequency characteristics of the stereo signal, to a first summing means and the first input being coupled, via a filter representing a far ear Head Related Transfer Function (HRTF), to a second summing means; and the second input being coupled through a second channel which does not significantly alter the frequency characteristics of the stereo signal to said second summing means, and, via a filter representing a far ear HRTF, to the first summing means, the outputs of the summing means providing stereo expanded signals; and wherein equalizing means is provided to compensate for a transfer function arising from the use of pan-potting to derive a stereo input signal from a mono signal, so as to create a tonal quality substantially similar to a stereo signal which has not been expanded.

2. Apparatus according to claim 1 including equalizing circuits connected between said first and second inputs and said first and second channels.

3. Apparatus according to claim 1 including equalizing circuits connected between said first and second inputs and said outputs of said summing means.

4. Apparatus according to claim 1 wherein the first channel includes a delay circuit and an attenuator circuit.

5. Stereo expansion apparatus comprising first and second inputs for receiving respective left and right stereo signals, the first input being coupled through a first channel which does not significantly alter the frequency characteristics of the stereo signal, to a first summing means and the first input being coupled, via a filter representing a far ear Head Related Transfer Function (HRTF), to a second summing means; and the second input being coupled through a second channel which does not significantly alter the frequency characteristics of the stereo signal to said second summing means, and, via a filter representing a far ear HRTF, to the first summing means, the outputs of the summing means providing stereo expanded signals;

wherein the outputs of the first and second summing means are arranged to be coupled to headphones; and wherein equalizing means is provided to compensate for a transfer function arising from the use of pan-potting to derive a stereo input signal from a mono signal, so as to create a tonal quality substantially similar to a stereo signal which has not been expanded.

6. Stereo expansion apparatus comprising first and second inputs for receiving respective left and right stereo signals, the first input being coupled through a first channel which does not significantly alter the frequency characteristics of the stereo signal, to a first summing means and the first input being coupled, via a filter representing a far ear Head Related Transfer Function (HRTF), to a second summing means; and the second input being coupled through a second channel which does not significantly alter the frequency characteristics of the stereo signal to said second summing means, and, via a filter representing a far ear HRTF, to the first summing means, the outputs of the summing means providing stereo expanded signals;

wherein the outputs of the first and second summing means are coupled to crosstalk cancellation means, the outputs of which are adapted to be connected to left and right loudspeakers; and wherein equalizing means is provided to compensate for a transfer function arising from the use of pan-potting to derive a stereo input signal from a mono signal, so as to create a tonal quality substantially similar to a stereo signal which has not been expanded.

7. Apparatus according to claim 5 including equalizing circuits connected between said first and second inputs and said first and second channels.

8. Apparatus according to claim 5 including equalizing circuits connected between said first and second inputs and said outputs of said summing means.

9. Apparatus according to claim 6 including equalizing circuits connected between said first and second inputs and said first and second channels.

10. Apparatus according to claim 6 including equalizing circuits connected between said first and second inputs and said outputs of said summing means.

* * * * *